US005460223A

United States Patent [19]

Economides

[11] Patent Number: 5,460,223

[45] Date of Patent: Oct. 24, 1995

[54] METHOD AND SYSTEM FOR OIL RECOVERY

[76] Inventor: Michael J. Economides, 13040 Trail Hollow, Houston, Tex. 77079

[21] Appl. No.: 287,210

[22] Filed: Aug. 8, 1994

[51] Int. Cl.[6] ..... E21B 43/25

[52] U.S. Cl. ..... 166/249; 166/177.1

[58] Field of Search ..... 166/249, 245, 166/50, 52, 177

[56] References Cited

U.S. PATENT DOCUMENTS

| | | | |
|---|---|---|---|
| 2,670,801 | 3/1954 | Sherborne | 166/21 |
| 2,700,422 | 1/1955 | Bodine, Jr. | 166/249 |
| 2,796,129 | 6/1957 | Brandon | 166/249 |
| 3,322,196 | 5/1967 | Bodine, Jr. | 166/249 |
| 3,583,677 | 6/1971 | Phillips | 259/1 |
| 3,952,800 | 4/1976 | Bodine | 166/249 |
| 3,990,512 | 11/1976 | Kuris | 166/249 |
| 4,060,128 | 11/1977 | Wallace | 166/249 |
| 4,074,758 | 2/1978 | Scott | 166/249 |
| 4,109,715 | 8/1978 | Adamson | 166/177 |
| 4,257,482 | 3/1981 | Kompanek | 166/249 |
| 4,323,119 | 4/1982 | Bodine | 166/249 X |
| 4,437,518 | 3/1984 | Williams | 166/248 |
| 4,469,175 | 9/1984 | Massa | 166/249 |
| 4,470,459 | 9/1984 | Copland | 166/248 |

(List continued on next page.)

OTHER PUBLICATIONS

Krylov A. L., Nikolayevsky, V. N. and Ely, G. A., "*Mathematical Model of Nonlinear Generation of Ultrasound by Seismic Waives*" (in Russian), published in 1991, pp. 1340–1345.

V. N. Nikolaevskiy, "*Using Vibrations to Produce Oils From Water–Flooded Shallow Reservoirs*", Inst. of Physics of the Earth, Russian Academy of Sciences, Feb. 1994, pp. 1–7.

O. Brulin and S. Hjalmars, "*Linear Grade–Consistent Micropolar Theory*", Int. J. Engng. Sci. vol. 19, No. 12, pp. 1731–1738, 1981, Printed in Great Britain.

Viktor N. Nikolaevskii, "Dynamics of Viscoelastic Media With Internal Oscillators", Inst. of Physics of the Earth USSR Academy of Sciences, pp. 210–221.

L. N. Rykunov, O. B. Khavroshkin and V. V. Tsyplakov, "*Time Variation of High–Frequency Seismic Noise*", Izvestiya, Earth Physics, vol. 15, No. 11, 1979, pp. 829–833.

N. A. Vil'Chinskaya and V. N. Nikolayevskiy, "*The Acoustical Emission and Spectrum of Seismic Signals*", Izvestiya, Earth Physics, vol. 20, No. 5, 1984, pp. 393–400.

N. A. Vil'Chinskaya, "*The Remodeling Wave in Sand and Acoustic Emission*", All–Union Inst. of Marine Geology and Geophysics, Riga, Jun. 25, 1981, 4 pages.

V. N. Nikolayevskiy, "*Mechanism and Dominant Frequencies of Vibrational Enhancement of Yield of Oil Pools*", Schmidt Inst. of Physics of the Earth, USSR Academy of Sciences, Moscow, Jan. 8, 1988, 4 pages.

A. B. Pogosyan, E. M. Simkin, E. V. Stremovskiy, M. L. Surguyev and A. I. Shnirel'man, "*Separation of Hydrocarbon Fluid and Water in an Elastic Wave Field Acting on a Porous Reservoir Medium*", Krylov All–Union Oil and Gas Inst., Moscow, Mar. 5, 1988, 3 pages.

A. V. Nikolayev, G. I., Voytov, V. V. Kuznetsov, S. M. Ammosov, O. B. Khavroshkin, Yu. M. Teytel'baum, A. N. Katsonis, L. V. Saprykin and G. S. Kir'yanova, "*Resonant Geochemical Response of Oil–Bearing Stratum to a Seismic Stimulus*", Schmidt Inst. of Physics of the Earth, USSR Academy of Sciences, Moscow, Apr. 17, 1988, pp. 35–39.

*Primary Examiner*—Ramon S. Britts
*Assistant Examiner*—Frank S. Tsay
*Attorney, Agent, or Firm*—Westman, Champlin & Kelly

[57] ABSTRACT

A method and an apparatus for recovering oil from a oil bearing formation having a mixture of oil and water. A first borehole and a second borehole are formed in oil bearing .formation and extend in a horizontal direction. The first borehole is disposed below the second borehole. Seismic waves are generated in the oil bearing formation to reorganize the mixture into oil and water to promote flow of the oil to the second borehole, the seismic waves emanating from the first borehole. The oil is then recovered from the second borehole.

19 Claims, 2 Drawing Sheets

OTHER PUBLICATIONS

| | | | |
|---|---|---|---|
| 4,471,830 | 9/1984 | Bodine | 166/249 |
| 4,558,737 | 12/1985 | Kuznetsov et al. | 166/60 |
| 4,577,691 | 3/1986 | Huang et al. | 166/263 |
| 4,624,306 | 11/1986 | Traver et al. | 166/53 |
| 4,665,980 | 5/1987 | Bodine | 166/249 |
| 4,673,037 | 6/1987 | Bodine | 166/249 |
| 4,674,571 | 6/1987 | Vogen | 166/249 |
| 4,702,315 | 10/1987 | Bodine | 166/249 |
| 4,716,555 | 12/1987 | Bodine | 367/35 |
| 4,785,886 | 11/1988 | Renard | 166/370 |
| 4,788,467 | 11/1988 | Plambeck | 310/323 |
| 4,817,712 | 4/1989 | Bodine | 166/249 |
| 4,850,449 | 7/1989 | Cheung | 181/101 |
| 4,884,634 | 12/1989 | Ellingsen | 166/248 |
| 4,997,044 | 3/1991 | Stack | 166/385 |
| 5,004,050 | 4/1991 | Sizonenko et al. | 166/248 |
| 5,016,709 | 5/1991 | Combe et al. | 166/245 |
| 5,101,899 | 4/1992 | Hoskins et al. | 166/248 |
| 5,184,678 | 2/1993 | Pechkov et al. | 166/249 |
| 5,244,041 | 9/1993 | Renard et al. | 166/268 |
| 5,282,508 | 2/1994 | Ellingsen et al. | 166/249 |

METHOD AND SYSTEM FOR OIL RECOVERY

BACKGROUND OF THE INVENTION

The present invention relates to the recovery of heavy hydrocarbons, hereinafter "oil", from an oil bearing formation wherein the oil is disposed in the formation with water. More specifically, the present invention induces vibrations in the oil bearing formation to reorganize the oil to allow improved rates of recovery.

Many water-flooded oil reservoirs exist throughout the world. Although these reservoirs contain oil, commonly the oil-water ratio of effluent recovered is so low that it makes recovery of the oil cost prohibitive. In these situations, recovery is discontinued even though a considerable quantity of oil may yet remain in the reservoir.

SUMMARY OF THE INVENTION

A method and an apparatus for recovering oil from an oil bearing formation having a mixture of oil and water includes a first substantially horizontal borehole and a second substantially horizontal borehole formed in the oil bearing formation. The first borehole is disposed substantially below the second borehole. Vibrations are generated in the oil bearing formation to reorganize the mixture of oil and water in order to promote flow of the oil to the second borehole, the vibrations emanating from the first borehole. The oil is then recovered from the second borehole.

In the embodiment described below, preferably, a plurality of spaced apart vibrators are disposed in the first borehole to produce vibrations in the oil bearing formation adjacent thereto. Generally, the vibrations promote microscopic reorganization and macroscopic resegregation of the oil. By placing the vibrators in the first borehole efficient transfer of vibrations to the oil bearing formation is realized with lower energy demands. In addition, the amplitude, frequency and energy of the generated vibrations are adjusted to be optimal for the geological characteristics of the oil bearing formation.

DETAILED DESCRIPTION OF THE PREFERRED EMBODIMENTS

Figure 1:
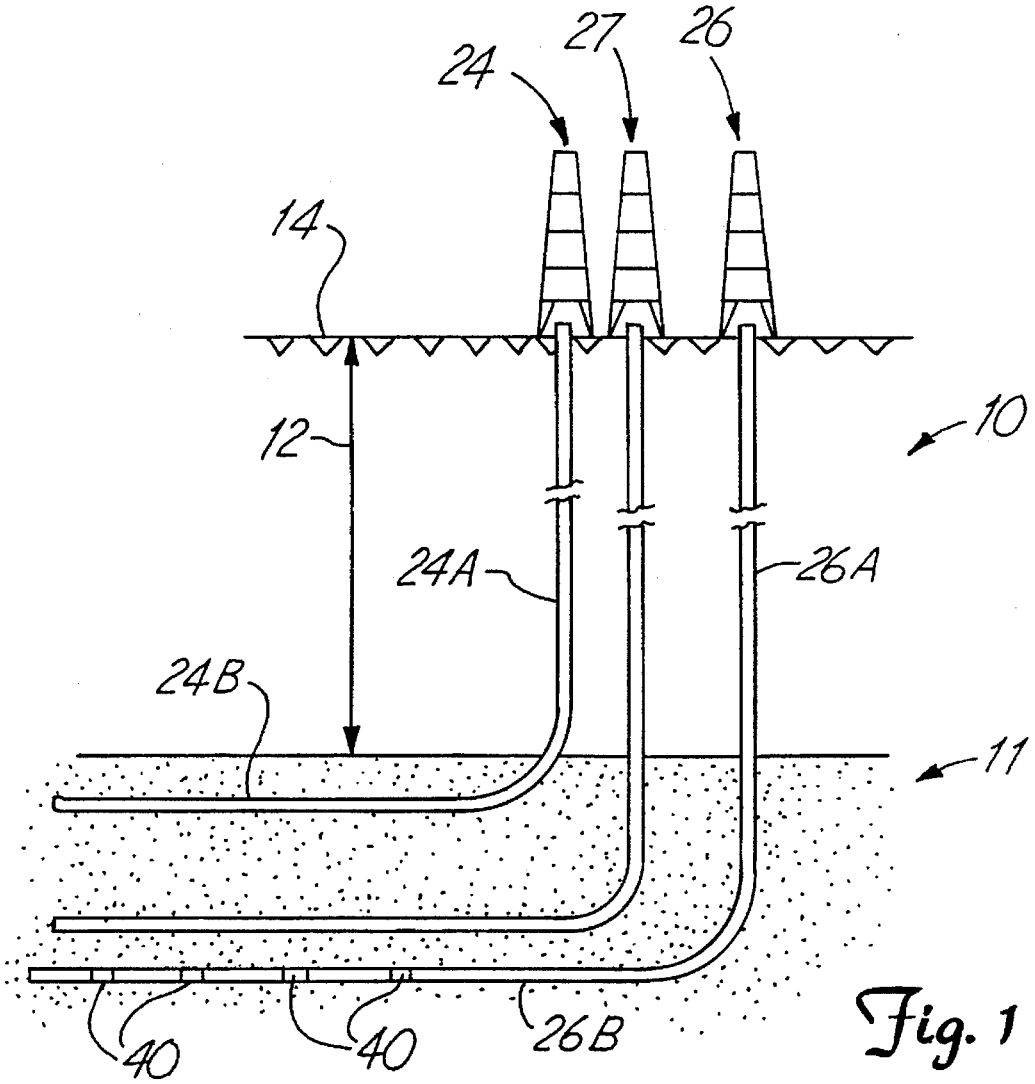
FIG. 1 is a schematic representation of apparatus of the present invention disposed in an oil bearing formation.

FIG. 1 illustrates a sectional view of an oil bearing formation 10 having an oil reservoir indicated generally at 11. The oil reservoir 11 is located at a known depth illustrated by double arrow 12 from an upper surface 14. The apparatus and method of the present invention allows recover of the oil from the reservoir 11 when other known conventional means are unsuccessful.

Figure 2:
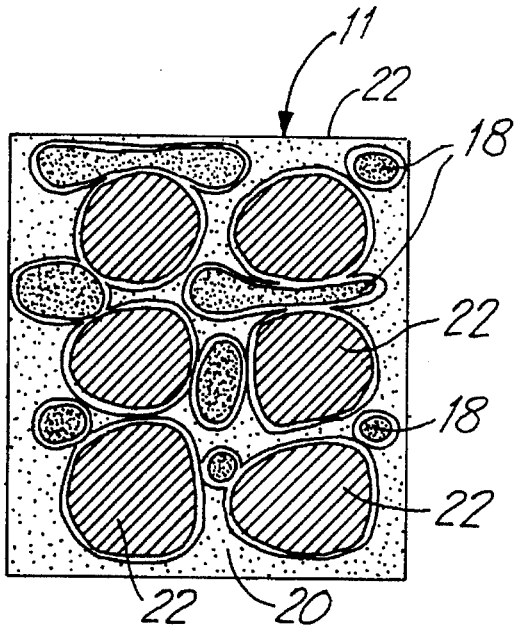
FIG. 2 is an enlarged schematic representation of the oil bearing formation.

Referring to FIG. 2, the reservoir 11 comprises residual oil droplets or films 18 distributed in pore spaces of the formation 10 wherein grains of the formation are indicated at 22. Water 20 also is located in the formation 10 and in combination with the grains 22 entraps the oil droplets 18 within the formation 10. The present invention provides an apparatus and method for recovering the droplets of oil 18 from the formation 10 by the use of high-frequency waves that reorganize the micro-states of oil-water flow. Reorganization leads to (1) clusterization of oil droplets 18 to form individual oil "streams", (2) decrease in the individual size of the oil droplets 18 to a volume suitable for flow through available channels in the porous media of the formation 10, and (3) release of gas adsorbed in the formation 10 or dissolved in oil and water phases.

Referring back to FIG. 1, wells 24 and 26 are drilled, which, starting at the upper surface 14 have initial practically vertical sections 24A and 26A, followed by inclined or substantially horizontal sections 24B and 26B that extend within the reservoir 11. The horizontal bore sections 24B and 26B of each of the wells are drilled so as to locate one of the horizontal bore sections above the other. As illustrated, the horizontal bore section 24B is located above the horizontal bore section 26B. It should be understood that it is not necessary to locate the horizontal bore section 26B directly below the horizontal bore section 24B nor is it necessary that the bore sections 24B and 26B be absolutely horizontal or for that matter even parallel. As described below, the oil droplets 18 are reorganized so that the oil migrates upward toward the surface 14. It is only necessary that the bore section 24B be suitably positioned within the oil bearing formation 10 to intercept the flow of the reorganized oil.

Figure 3:
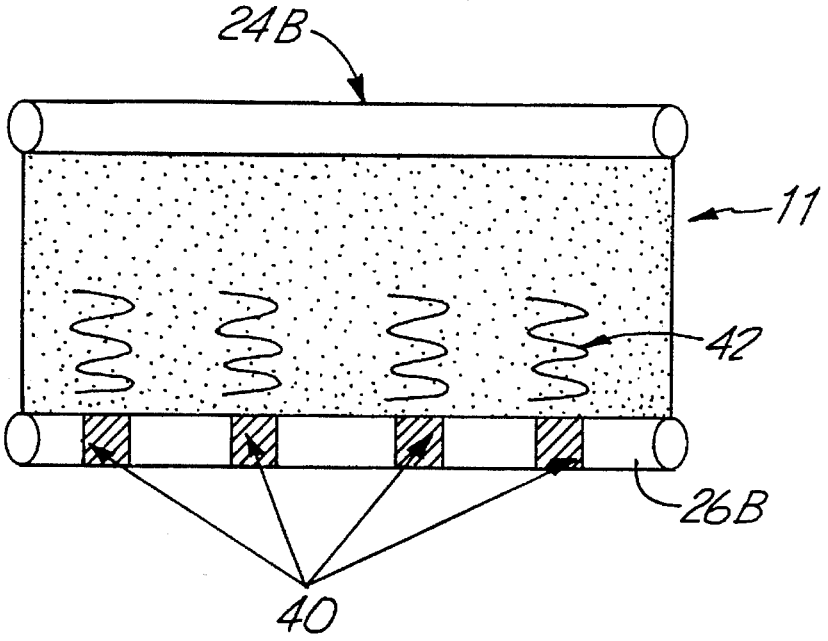
FIG. 3 is an enlarged sectional view of the oil bearing formation including portions of the apparatus of the present invention.

Referring also to FIG. 3, at least one, and preferably a plurality of suitable vibrators 40 are placed in the horizontal bore section 26B. The vibrators 40 generate seismic waves, illustrated schematically at 42, of selected frequencies and amplitude that propagate within the oil reservoir 11. The seismic waves 42 reorganize the oil droplets 18 (FIG. 2) so that the oil can migrate toward the upper surface 14 since the oil has a density less than that of the water 20, thereby increasing the oil-water ratio of the mixture recovered by the well 24. Additional recovery wells similar to well 24 can be used, if desired.

The amplitude, frequency, and energy of the seismic waves 42 generated by the vibrators 40, and a distance between the horizontal bore sections 24B and 26B are chosen based upon the geophysical characteristics of the oil bearing formation 10 such as elastic and viscoelastic properties, and standard reservoir characteristics, such as permeability, porosity, and saturation.

It is believed that the seismic waves 42 accelerate the macroscopic resegregation of oil and water and also lead to the microscopic reorganization of oil-water flow and the reconstitution of relative permeability to oil. Macroscopic resegregation of oil and water is simply the separation of oil and water in quantities that are large enough to be observed by the naked eye. Microscopic reorganization of oil-water flow, which requires the use of a microscope to be observed, is thought to be more complex than macroscopic resegregation.

It is believed that the seismic waves 42 generated by the vibrators 40 propagate in the porous and fractured media 10 and by so doing generate high-frequency waves. Specifically, the seismic waves 42 cause relative motions of the grains 22 of the formation 10 which when collide with one another generate high-frequency (ultrasonic) waves. These high-frequency waves act on oil droplets 18. This action reorganizes the micro-states of oil-water flow, and reconstitutes the relative permeability to oil at saturations smaller than the residual oil saturation. Note that the seismic waves 42 that have been generated with vibrators 40 generally were not of high-frequency. The reason is that high-frequency waves cannot propagate in porous or fractured rocks deeper than a few centimeters or, at the most, meters into the formation 10. Instead, high-frequency waves are caused by the seismic waves 42 themselves while they propagate in porous or fractured rocks. It is believed seismic waves having a frequency of 1 to 100 Hz will suffice for most applications. The vibrators are operated either continuously or intermittently.

It is believed a known nonlinear grade-consistent micropolar continuum model describes how seismic waves generate high-frequency waves. In the case of 1-D dynamics, the following system of two coupling equations exist:

$$\frac{\partial^2 u}{\partial t^2} - v_1^2 \frac{\partial^2 u}{\partial x^2} - V\frac{\partial u}{\partial x} \quad \frac{\partial^2 u}{\partial x^2} - \delta \frac{\partial^4 u}{\partial x^4} - \chi \frac{\partial \phi}{\partial x} = 0 \tag{1a}$$

$$\frac{\partial^2 \phi}{\partial t^2} - v_2^2 \frac{\partial^2 \phi}{\partial x^2} + a\phi - \left( v_2^2 \frac{\partial^2 \phi}{\partial x^2} - a\phi \right) \frac{\partial u}{\partial x} = 0 \tag{1b}$$

where u is the mean displacement of rock masses (cm), $\phi$ is rotation angle of geomaterial grains (radians), $v_1$ and $v_2$ are wave velocities (cm/sec), v and $\delta$ are areal elastic coefficients ($cm^2/sec^2$) is X is volumetric elastic coefficients ($cm^3/sec^2$), $\chi$ is coupling coefficient ($sec^{-2}$), t is time (sec), and x is coordinate (cm).

The condition for the energy transfer from seismic waves to high-frequency waves is that the group velocity of high-frequency waves, $v_g$, is equal to the phase velocity of seismic waves, $v_1$.

$$v_g \equiv \left( \frac{d\omega}{dq} \right)_{high\text{-}frequency\ waves} = \left( \frac{\omega}{q} \right)_{seismic\ waves} \equiv v_1 \tag{2}$$

where $\omega$ is wave frequency ($sec^{-1}$), and q is wave number ($cm^{-1}$).

The resonance given by Equation 2 is known as a short-long-wave resonance, which is a nonlinear resonance. Seismic waves are long waves with low frequencies. High-frequency waves are short waves with high frequencies.

Vibrations will be far more effective if the characteristic dominant frequency waves are generated and used. Evolution of seismic waves with other frequencies to seismic waves with dominant frequencies obeys the following known equation of seismic wave evolution:

$$\frac{\partial v_d}{\partial t} + N v_d \frac{\partial v_d}{\partial x} = \sum_p (-1)^{p+1} \frac{\partial^{p+1} v_d}{\partial x^{p+1}} \tag{3}$$

where $v_d$ is the displacement velocity of geomaterial (cm/sec), N is coefficient of nonlinearity (dimensionless), and $a_p$'s are coefficients ($cm/sec^{-(p+2)}$.

The larger the coefficient of nonlinearity (N), the quicker the transfer of seismic wave energy to the dominant frequency.

The dominant frequency depends on the type and packing of the geomaterial grains. It also depends on the type and properties of the fluid contained in the porous media. In some cases, the dominant frequency, $\omega_1$ (Hz), can be estimated by Equation 4.

$$\omega_1 = \frac{v}{d_1} \sqrt{\frac{\lambda}{2\mu^*}} \tag{4}$$

where v is the wave velocity (m/sec), $d_1$ is the grain diameter of rocks (m), $\mu$ is the viscosity of oil (Pa.sec), and $\mu^*$ is the vibrational viscosity of rocks (Pa.sec).

Formation stratification can also control dominant frequencies in certain other cases. The following equations represents the dominant frequency, $\omega_2$, controlled by stratification:

$$\omega_2 = 4\frac{v}{h} \tag{5}$$

where v is the wave velocity (m/sec), and h is the layer thickness (m).

The actual dominant frequency, $\omega_d$ (Hz), is given by Equation 6.

$$\omega_d = \min\{\omega_1, \omega_2\} \tag{6}$$

Seismic waves generated by vibrators propagate in formation rocks, and the amplitudes of propagating seismic waves decrease for various reasons including wave front surface increases, wave attenuation and wave resonance. The following equations provide estimates for losses attributable to each of the above-identified reasons.

If a seismic wave is generated by a point or spherical vibrating source in a isotropic, homogeneous, and infinite medium, the wave front surface is spherical, and the following equation represents the wave amplitude, A (m), at a given distance r(m):

$$A = (r_o A_o)\frac{1}{r} \tag{7}$$

where $A_0$ is the wave amplitude at the vibrating source $r_0$.

If the medium is anisotropic, the wave front surface will be ellipsoidal.

If the seismic wave is generated by a line or cylindrical vibrating source in an isotropic, homogeneous and infinite medium, the wave front surface is cylindrical, and the following equation is used to determine the amplitude.

$$A = (\sqrt{r_o}\, A_o)\frac{1}{\sqrt{r}} \tag{8}$$

If the medium is anisotropic, the wave front surface will be elliptic-cylindrical.

Secondly, since the actual porous media are viscoelastic, a part of the seismic wave energy dissipates, and the propagating wave attenuates. The following equation provides an estimate for the wave amplitude A (m) at a distance r(m):

$$A = A_0 \exp(-\alpha r) \tag{9}$$

where $\alpha$ is the attenuation coefficient (damping factor) (1/m), and where the following equation is used estimate the attenuation coefficient, $\alpha$.

$$\alpha = \frac{1}{2} \quad \frac{\omega}{vQ} \tag{10}$$

where v is the wave velocity (m/s). Q is the quality factor of the wave (dimensionless), which depends on the type and packing of geomaterial grains, and on the type and properties of fluid in the porous rocks. Usually, Q is estimated from experiments, but can also be calculated using known procedures.

Lastly, a part of the propagating wave energy will be used for resonance, and the wave amplitude will be decreased. Commonly, energy flux is used to represent energy. Energy flux (I) is defined as the energy (E) per unit time (t) and per unit area (A). That is, I=E/(At).

The following equation provides an estimate for the seismic wave energy flux, $I_0$ ($W/m^2$), at the vibrating sources:

$$I_0=\beta A_0^2\omega^2\rho v \tag{11}$$

where ρ is the density of medium ($kg/m^3$), v is the wave velocity (m/sec), and β is a coefficient (dimensionless), which depends on the wave propagating geometry.

Equation 12 is used to estimate the propagating seismic wave energy flux, I, at other locations.

$$I=\beta A^2\omega^2\rho v \tag{12}$$

From Equations 11 and 12, the following equation is realized:

$$\frac{I}{I_o}=\left(\frac{A}{A_o}\right)^2 \tag{13}$$

It is obvious that the energy flux decreases for spherical and cylindrical waves are given by Equations 14 and 15, respectively.

$$\text{For spherical waves:}\quad \frac{I}{I_o}=(r_o^2)\frac{1}{r^2} \tag{14}$$

$$\text{For cylindrical waves:}\quad \frac{I}{I_o}=(r_o^2)\frac{1}{r} \tag{15}$$

The energy flux decreases due to attenuation is given by Equation 16.

$$\frac{I}{I_o}=[\exp(-\alpha r)]^2=\exp(-2\alpha r) \tag{16}$$

Equation 17 represents the necessary energy balance:

$$E_t=E_d+E_p+E_r \tag{17}$$

where $E_t$ is the total energy generated by the vibrating sources, $E_d$ is the energy dissipated, $E_p$ is the energy being carried by the propagating seismic waves, and $E_r$ is the energy used for resonance.

On the one hand, it is desirous to have the low-frequency seismic wave energy transferred efficiently into high-frequency wave energy through nonlinear long-short-wave resonance. On the other hand, an adequate amount of energy must remain and be carried by the propagating waves to influence more reservoir areas and to be used for generating high-frequency waves through resonance.

Referring back to FIG. 1, conventional oil recovery techniques can also be used in conjunction with the vibrators 40 described above. For instance, if desired, water and/or steam can be injected into the well 26, or into an adjacent well 27, using known techniques. As water or steam "sweeps" the oil reservoir 11, it undergoes viscous fingering wherein the water or steam follows paths of least resistance. Once a "breakthrough" occurs much of the oil reservoir is difficult to sweep. By placing and operating vibrators under the anticipated water or steam sweeping path, segregation of the propagating phases is controlled thereby improving the oil relative permeability of the propagating front.

In summary, the present invention provides an apparatus and method to recover oil that has been previously unrecoverable by conventional means. Use of the two horizontal wells provides efficient means to introduce seismic waves into the formation and recover oil therefrom.

Although the present invention has been described with reference to preferred embodiments, workers skilled in the art will recognize that changes may be made in form and detail without departing from the spirit and scope of the invention.

What is claimed is:

1. A method for recovering oil from an oil bearing formation wherein the oil bearing formation includes a mixture of oil and water, the method comprising:

forming a first borehole and a second borehole in the oil bearing formation that extend in a horizontal direction, the first borehole being disposed below the second borehole;

generating seismic waves in the formation to reorganize the mixture of oil and water to promote flow of the oil to the second borehole, the seismic waves emanating from the first borehole; and recovering oil from the second borehole.

2. The method of claim 1 and further comprising placing a vibrator in the first borehole, and wherein the step of generating comprises operating the vibrator to produce seismic waves.

3. The method of claim 2 wherein the step of placing comprises placing a plurality of spaced apart vibrators in the first borehole, and wherein the step of generating comprises operating each of the vibrators to produce seismic waves.

4. The method of claim 3 wherein the step of generating comprises generating seismic waves intermittently.

5. The method of claim 1 and further comprising:

injecting water into the formation to promote oil flow to the second borehole.

6. The method of claim 5 and further comprising:

forming a third borehole in the oil formation that extends in a horizontal direction, the third borehole being disposed between the first and second boreholes; and wherein the step of injecting water comprises injecting water in the third borehole to promote oil flow to the second borehole.

7. The method of claim 5 wherein the water includes steam.

8. The method of claim 1 wherein the seismic waves include seismic waves at a frequency to promote microscopic reorganization of oil.

9. The method of claim 8 wherein the seismic waves include seismic waves at a frequency to promote macroscopic resegregation of oil.

10. The method of claim 8 wherein the seismic waves include a range of frequencies from 1 Hz to 100 Hz.

11. An apparatus for recovering oil from an oil bearing formation wherein the oil bearing formation includes a mixture of oil and water, the apparatus comprising:

means for drilling a first borehole and a second borehole that extend in a horizontal direction, the first borehole being disposed below the second borehole means for generating seismic waves in the oil bearing formation to reorganize the mixture of oil and water, the seismic waves emanating from the first borehole; and means for recovering oil from the second borehole.

12. The apparatus of claim 11 wherein the means for generating comprises a vibrator disposed in the first borehole.

13. The apparatus of claim 11 wherein the means for generating comprises a plurality of spaced apart vibrators disposed in the first borehole.

14. The apparatus of claim 11 wherein the means for generating generates seismic waves intermittently.

15. The apparatus of claim 1 wherein the means for drilling forms a third borehole in the oil formation that extends in a horizontal direction, the third borehole being disposed between the first borehole and the second borehole, the apparatus further comprising means for injecting water in the third borehole to promote oil flow to the second borehole.

16. The method of claim 15 wherein the water includes steam.

17. The method of claim 11 wherein the seismic waves include seismic waves at a frequency to promote microscopic reorganization of oil.

18. The method of claim 17 wherein the seismic waves include seismic waves at a frequency to promote macroscopic resegregation of oil.

19. The method of claim 17 wherein the seismic waves include a range of frequencies from 1 Hz to 100 Hz.

* * * * *

UNITED STATES PATENT AND TRADEMARK OFFICE

CERTIFICATE OF CORRECTION

PATENT NO. : 5,460,223

DATED : October 24, 1995

INVENTOR(S) : Michael J. Economides

It is certified that error appears in the above-indentified patent and that said Letters Patent is hereby corrected as shown below:

Title page, Item [56] Reference Cited:

U.S. Patent Documents

Replace "4,471,830 9/1984 Bodine .... 166/249"

with --4,471,838 9/1984 Bodine .... 166/249--.

Column 3, line 65, replace

" $$\omega_1 = \frac{V}{d_1}\sqrt{\frac{\lambda}{2\mu *}} \qquad (4)$$ "

with

-- $$\omega_1 = \frac{V}{d_1}\sqrt{\frac{\mu}{2\mu *}} \qquad (4)$$ --.

Signed and Sealed this

Fifth Day of March, 1996

*Attest:*

*Attesting Officer*

BRUCE LEHMAN

*Commissioner of Patents and Trademarks*